US011162289B2

(12) United States Patent
Wei

(10) Patent No.: US 11,162,289 B2
(45) Date of Patent: Nov. 2, 2021

(54) BIDIRECTIONAL DAMPER AND SHOWER DOOR ASSEMBLY

(71) Applicant: Foshan Ideal Co., Ltd., Guangdong (CN)

(72) Inventor: Wuxiang Wei, Guangdong (CN)

(73) Assignee: Foshan Ideal Co., Ltd.

( * ) Notice: Subject to any disclaimer, the term of this patent is extended or adjusted under 35 U.S.C. 154(b) by 0 days.

(21) Appl. No.: 16/970,262

(22) PCT Filed: Jun. 24, 2019

(86) PCT No.: PCT/CN2019/092509
§ 371 (c)(1),
(2) Date: Aug. 14, 2020

(87) PCT Pub. No.: WO2020/257961
PCT Pub. Date: Dec. 30, 2020

(65) Prior Publication Data
US 2021/0180382 A1 Jun. 17, 2021

(51) Int. Cl.
*E05F 5/00* (2017.01)
*E05F 5/10* (2006.01)
(Continued)

(52) U.S. Cl.
CPC ..... *E05F 5/003* (2013.01); *A47K 3/34* (2013.01); *E05F 1/16* (2013.01); *E05F 5/10* (2013.01);
(Continued)

(58) Field of Classification Search
CPC .... E05F 5/003; E05F 5/10; E05F 1/16; E05Y 2201/212; E05Y 2900/114
See application file for complete search history.

(56) References Cited

U.S. PATENT DOCUMENTS 8,186,489 B2 * 5/2012 Zimmer ..... E05F 5/027 188/265
8,307,497 B2 * 11/2012 Chang ..... E05F 5/003 16/71
(Continued)

FOREIGN PATENT DOCUMENTS

CN 103147645 A 6/2013
CN 104328990 A 2/2015
(Continued)

OTHER PUBLICATIONS

International Search Report for Application No. PCT/CN2019/092509, dated Mar. 2, 2020, pp. 1-3.

*Primary Examiner* — Jeffrey O'Brien
(74) *Attorney, Agent, or Firm* — Lerner, David, Littenberg, Krumholz & Mentlik, LLP

(57) ABSTRACT

A bidirectional damper comprises a mounting bracket, a tension spring, two damping cylinders and two engaging members; the mounting bracket comprises a first bracket plate, a second bracket plate and a connecting plate connected between the first bracket plate and the second bracket plate, the connecting plate comprises a main body section and extension sections at two ends of the main body section; the damping cylinder, the tension spring and the two engaging members are located between the first bracket plate and the second bracket plate, the damping cylinder and the tension spring are respectively arranged at two sides of the connecting plate, and the two extension sections are bent from the main body section towards the tension spring.

10 Claims, 5 Drawing Sheets

(51) Int. Cl.
*E05F 1/16* (2006.01)
*A47K 3/34* (2006.01)

(52) U.S. Cl.
CPC ... *E05Y 2201/212* (2013.01); *E05Y 2900/114* (2013.01)

(56) References Cited

U.S. PATENT DOCUMENTS

| | | | | |
|---|---|---|---|---|
| 9,945,167 | B2 * | 4/2018 | Svara | E05F 5/003 |
| 10,221,604 | B2 * | 3/2019 | Zimmer | E05F 1/16 |
| 10,251,481 | B2 * | 4/2019 | Goetz | A47B 88/49 |
| 10,455,989 | B2 * | 10/2019 | Wei | E05D 13/00 |
| 10,724,285 | B2 * | 7/2020 | Dodge | E05F 5/003 |
| 2014/0026358 | A1 * | 1/2014 | Saito | E05F 3/00 16/72 |
| 2014/0033475 | A1 * | 2/2014 | Saito | E05F 5/003 16/49 |
| 2019/0024429 | A1 | 1/2019 | Wang | |
| 2020/0080358 | A1 * | 3/2020 | Iijima | E05D 15/1042 |
| 2020/0190882 | A1 * | 6/2020 | Bantle | E05F 5/003 |
| 2021/0010309 | A1 * | 1/2021 | Montecchio | E05F 5/003 |

FOREIGN PATENT DOCUMENTS

| | | | |
|---|---|---|---|
| CN | 105507720 | A | 4/2016 |
| CN | 205172231 | U | 4/2016 |
| CN | 106917839 | A | 7/2017 |
| CN | 107461102 | A | 12/2017 |
| CN | 107513938 | A | 12/2017 |
| JP | 2007182715 | A | 7/2007 |
| KR | 20160091679 | A | 8/2016 |
| WO | 2019091969 | A1 | 5/2019 |

* cited by examiner

BIDIRECTIONAL DAMPER AND SHOWER DOOR ASSEMBLY

CROSS-REFERENCE TO RELATED APPLICATIONS

The present application is a national phase entry under 35 U.S.C. § 371 of International Application No. PCT/CN2019/092509 filed Jun. 24, 2019, which is incorporated herein by reference.

TECHNICAL FIELD

The present disclosure relates to the field of sanitary equipment, in particular to a bidirectional damper and a shower door assembly.

BACKGROUND

In existing sliding shower door, in order to reduce the collision and noise between the movable door panel and the door frame, a damper is generally installed on a track of the shower door to buffer the movement of the movable door panel, and in order to effectively buffer the movement of the movable door panel in both directions of opening and closing the door, two dampers are installed on the track of the shower door in the prior art, and respectively buffer the movement of the movable door panel in two directions of opening and closing the door, because the installation of the dampers needs to occupy a certain space, the size of the track needs to be increased to place the dampers by adopting the two dampers, this results in an increase in the structural size of the track, and in addition in an increase in the cost of the shower door.

Technical Problem

Two dampers are required to be installed in the sliding shower door in the prior art to buffer the movement of the movable door panel in both directions for opening and closing the door respectively, thus the occupied space of the dampers is large, and the cost of the shower door is high; in addition, the damper structure in the prior art is complicated.

Technical Solution

The present disclosure provides a bidirectional damper which comprises a mounting bracket, a tension spring, a damping cylinder and two engaging members; the mounting bracket comprises a first bracket plate and a second bracket plate with opposite main surfaces, the first bracket plate and the second bracket plate are spaced apart along a first direction, the mounting bracket further comprises a connecting plate connected between the first bracket plate and the second bracket plate, the connecting plate comprises a main body section and two extension sections, wherein the first bracket plate, the second bracket plate and the connecting plate are all elongated plates, the length directions of the first bracket plate, the second bracket plate and the main body section are all in a second direction, the second direction is perpendicular to the first direction, and the main body section is connected between the two extension sections along the second direction; the damping cylinder, the tension spring and the two engaging members are all positioned between the first bracket plate and the second bracket plate; along a third direction, the damping cylinder and the tension spring are respectively arranged at two sides of the connecting plate, the third direction is perpendicular to the first direction, the third direction is perpendicular to the second direction, and both of the two extension sections are bent from the main body section towards the tension spring; the damping cylinder comprises two piston rods extending and retracting in the second direction, each of the two engaging members is hinged to a corresponding one of the two piston rods respectively, and damping directions of the two piston rods are opposite; the connecting plate is provided with two guide grooves passing through the connecting plate, each of the two guide grooves corresponds to a corresponding one of the two extension sections respectively, each of the guide grooves extends from corresponding extension section to the main body section, the guide grooves extend in the second direction on the main body section, each of the two engaging members is slidably arranged in a corresponding one of the two guide grooves respectively, and both of the two engaging members are connected with the tension spring; the engaging member is provided with a first guide, a first engaging tooth and a second engaging tooth, the first engaging tooth and the second engaging tooth are spaced apart along the second direction, and along the third direction, the first guide abuts against a side of the connecting plate facing away from the tension spring under the action of the tension spring, both the first engaging tooth and the second engaging tooth extend to a side of the connecting plate close to the damping cylinder.

In a preferred solution, the damping cylinder comprises two separate cylinder bodies, and each of the two cylinder bodies of the damping cylinder corresponds to a corresponding one of the two piston rods respectively; or the damping cylinder comprises a dual-chamber cylinder body, and two cylinder chambers of the damping cylinder each correspond to a corresponding one of the two piston rods respectively.

In another preferred solution, the engaging member is further provided with a second guide, a distance between the first guide and the second guide is greater than a thickness of the connecting plate, and the second guide abuts against a side of the connecting plate facing the tension spring.

In a further solution, the engaging member is further provided with a third guide, the third guide abuts against a side of the connecting plate facing away from the tension spring, and the second guide is located between the first guide and the third guide along the second direction.

In a further preferred solution, both ends of the tension spring in the second direction are connected to the two engaging members, respectively.

In another preferred solution, the tension spring includes a first tension spring and a second tension spring, one of the engaging members is connected with the first tension spring, and the other one of the engaging members is connected with the second tension spring, both the first tension spring and the second tension spring are connected with the mounting bracket.

In another preferred solution, two second engaging teeth are positioned between two first engaging teeth along the second direction, the first engaging tooth is provided with an inclined guide surface, and the inclined guide surface is positioned on a side of the first engaging tooth facing away from the second engaging tooth; the inclined guide surface is positioned on a side of the first engaging tooth facing away from the tension spring along the third direction.

In a further solution, the first engaging tooth is a bent structure and comprises a first bent section and a second bent section, along the second direction, an end of the first bent section away from the second engaging tooth is connected to a main body portion of the engaging member, and an end of the first bent section close to the second engaging tooth is connected to the second bent section; along the third direction, the second bent section is bent from the first bent section towards the tension spring, and a space is formed between a side of the second bent section facing the tension spring and the main body portion of the engaging member; the inclined guide surface is provided on the first bent section. The main body portion of the engaging member refers to a portion of the engaging member excluding the first engaging tooth.

In a further solution, the first engaging tooth further comprises a third bent section, along the third direction, an end of the second bent section facing the tension spring is connected with the third bent section; the engaging member is provided with a limiting structure having a limiting cavity with an opening facing the first engaging tooth, the second bent section penetrates into the opening of the limiting cavity, the third bent section is located in the limiting cavity, wherein the limiting structure restricts the third bent section from being separated from the limiting cavity.

The present disclosure provides a shower door assembly which comprises a movable door panel, a mounting base and the aforementioned bidirectional damper, wherein the bidirectional damper is mounted on the top or bottom of the movable door panel, the second direction is the same as a sliding direction of the movable door panel, the mounting bracket is fixed to the movable door panel, two limiting members are provided on the mounting base, each of the two limiting members corresponds to a corresponding one of the two engaging members respectively, and the limiting members are located on movement paths of corresponding engaging members.

Advantageous Effects

The bidirectional damper of the present disclosure can provide buffering in both positive and negative directions, so that in the shower door assembly of the present disclosure, the bidirectional damper and the limiting member on the mounting base cooperate to effectively buffer the opening and closing processes of the movable door panel, and the shower door assembly is simple in structure, wherein the mounting base may be a door frame, a guide rail and the like.

In the bidirectional damper of the present disclosure, the damping cylinder, the tension spring, the engaging member and the like are all hidden between the first bracket plate and the second bracket plate, which is beneficial to the simplicity of the external structure of the bidirectional damper; in addition, the connecting plate is adopted to separate the tension spring and the damping cylinder such that the mutual influence between the tension spring and the damping cylinder can be avoided, which is beneficial to promoting the reliability of the bidirectional damper.

In addition, due to the arrangement of the guide grooves, the first guide and the second guide, the engaging members can stably move along the corresponding guide grooves, and the reliability of the bidirectional damper is further improved.

According to the present disclosure, the inclined guide surface is arranged on the first engaging tooth, so that when the engaging member reaches the limiting member in the door opening and closing process of the movable door panel, even if the first engaging tooth and the limiting member interfere with each other, the limiting member can still force the first engaging tooth to move or deform towards the tension spring under the guidance of the inclined guide surface, so that the first engaging tooth smoothly passes through the limiting member, which is beneficial to the continuous normal operation of the bidirectional damper.

The number of the tension spring may be only one, which is beneficial to reducing the number of parts of the bidirectional damper, reducing the production difficulty of the bidirectional damper, simplifying the structure of the bidirectional damper, and improving the economy.

The first engaging tooth is designed to be a bent structure, so that even if the engaging member is located at the main body section when reaching the limiting member, the limiting member can force the first bent section to bend and deform towards the tension spring through extrusion deformation of the first engaging tooth, the first engaging tooth can pass through the limiting member, the limiting member can be guaranteed to smoothly reach the bayonet of the engaging member, the engaging member is guaranteed to smoothly return to the extension section when being disengaged from the limiting member, which is beneficial to the long-term normal operation of the bidirectional damper.

Under the restriction of the limiting structure, besides the first bent section can perform limited deformation and recovery deformation, the limiting structure restricts the second bent section to deform along the sliding direction, and restricts the deformation range of the first bent section by restricting the third bent section from being separated from the limiting cavity, so as to ensure the form stability of the first engaging tooth and the controllable deformation of the first engaging tooth.

The connecting plate abut against the first guide, the second guide and the third guide to limit the form of the engaging member in the guide groove, so as to prevent the engaging member from turning over, which is beneficial to ensuring the stable state of the engaging member.

The present disclosure will be further described below with reference to the accompanying drawings and embodiments.

EMBODIMENTS OF THE PRESENT DISCLOSURE

Figure 1:
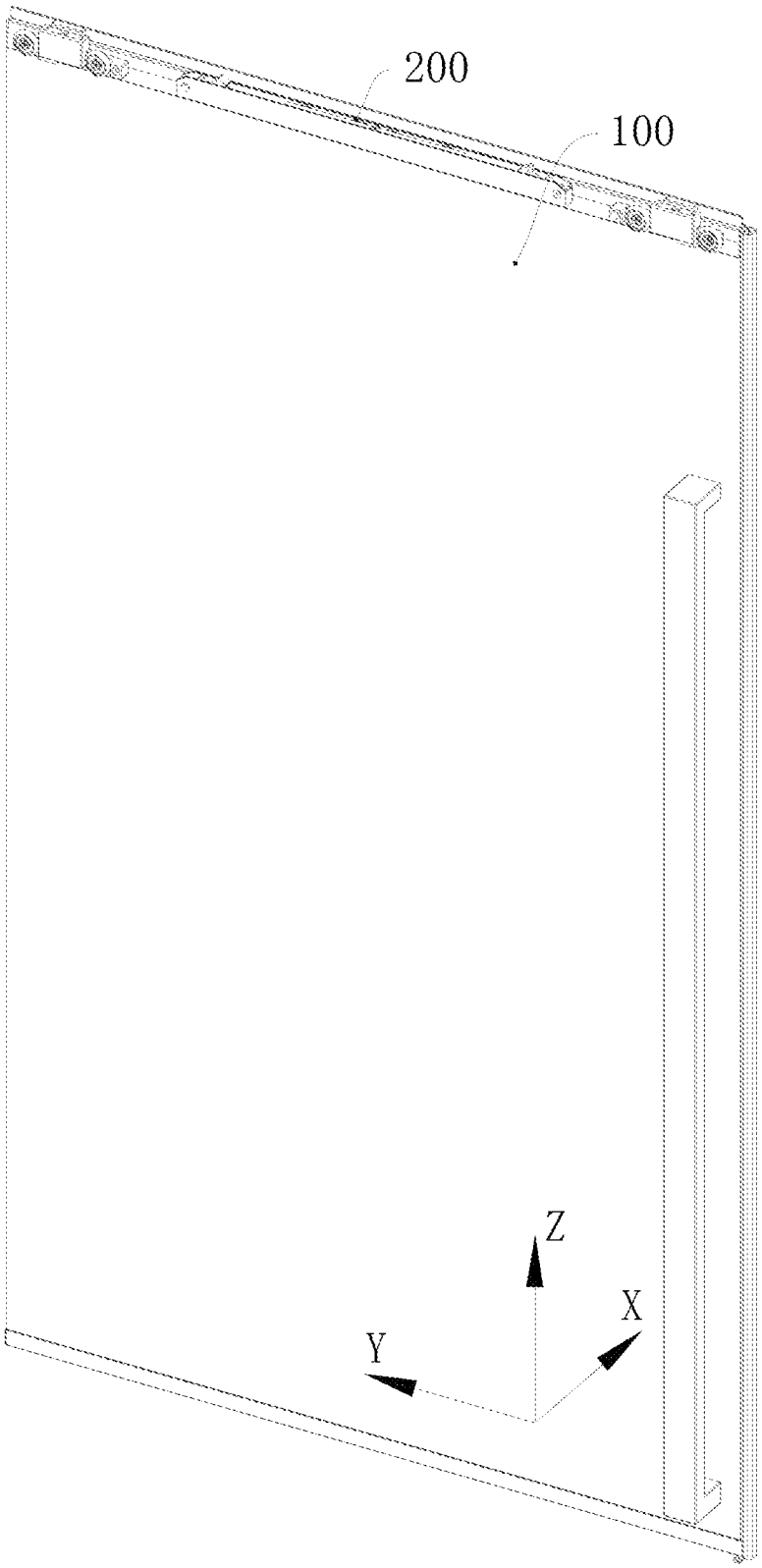
FIG. 1 is a structural view of parts of a shower door assembly according to an embodiment of the present disclosure.

Embodiments of bidirectional damper and shower door assembly:

The present embodiment is illustrated using a coordinate system as shown in FIG. 1.

Figure 2:
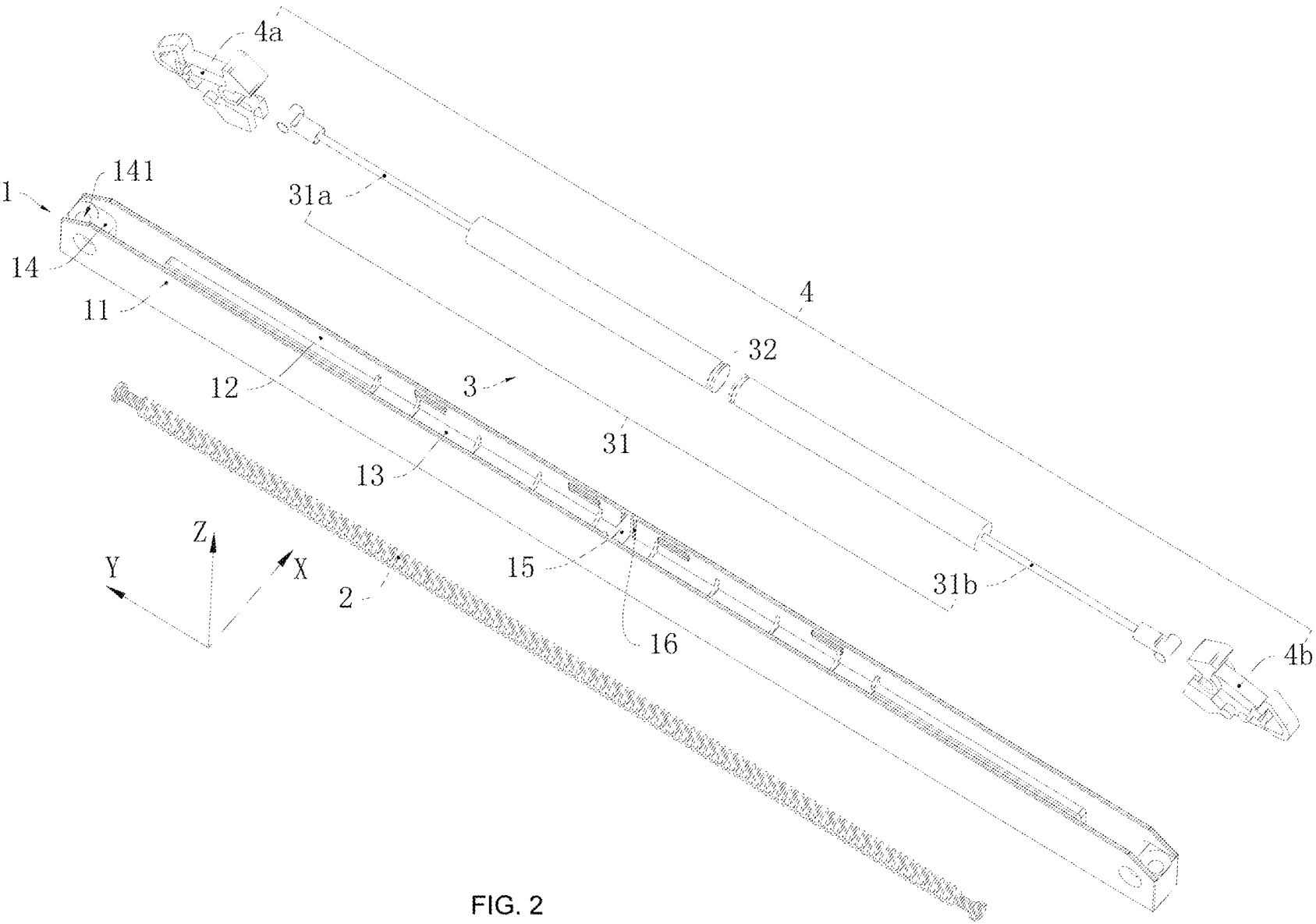
FIG. 2 is an exploded view of a bidirectional damper according to an embodiment of the present disclosure.

Referring to FIGS. 1 and 2, the shower door assembly of the present embodiment includes a movable door panel 100, a door frame (not shown), and a bidirectional damper 200 of the present embodiment, wherein the movable door panel 100 slides along the Y-axis direction relative to the door frame, the Z-axis direction is a vertical direction, the bidirectional damper 200 is mounted on the top of the movable door panel 100, and two limiting members (not shown) are disposed on the door frame. The bidirectional damper 200 of the present embodiment includes one mounting bracket 1, one tension spring 2, two damping cylinders 3, and two engaging members 4, wherein the two engaging members 4 are a first engaging member 4*a* and a second engaging member 4*b*, respectively, each of the two limiting members corresponds to a corresponding one of the two engaging members 4, and each limiting member is located on the movement path of the corresponding engaging member 4.

Figure 3:
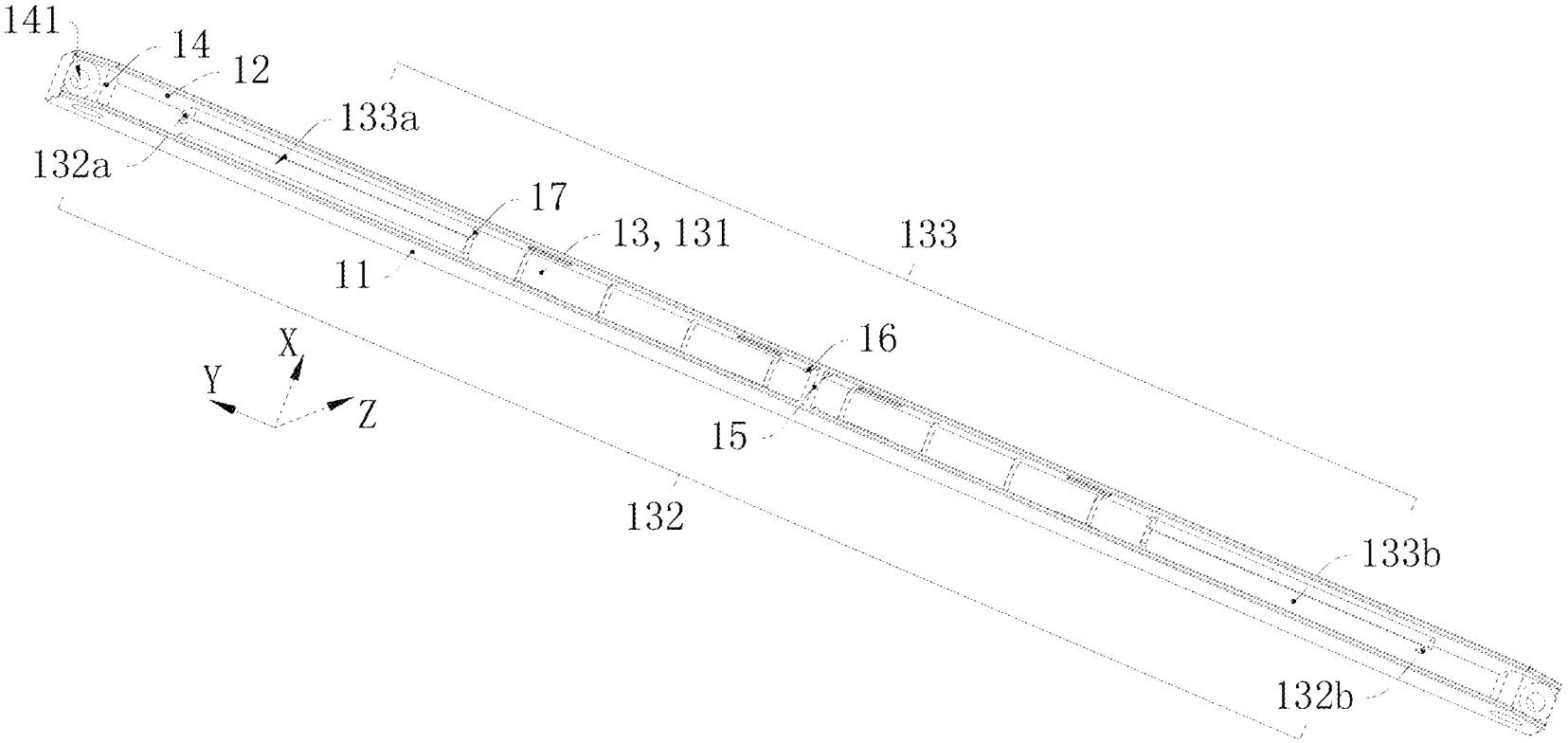
FIG. 3 is a structural view of a mounting bracket in a bidirectional damper according to an embodiment of the present disclosure.

Referring to FIG. 3, the mounting bracket 1 includes a first bracket plate 11, a second bracket plate 12, a connecting plate 13 and two fixing blocks 14, the connecting plate 13 includes a main body section 131 and two extension sections 132, the two extension sections 132 are a first extension section 132*a* and a second extension section 132*b* respectively, the first bracket plate 11, the second bracket plate 12 and the connecting plate 13 are all elongated plates, the length directions of the first bracket plate 11, the second bracket plate 12 and the main body section 131 are all in the Y-axis direction, the two extension sections 132 are connected to two ends of the main body section 131 in the Y-axis direction respectively, and both of the two extension sections 132 are bent from the main body section 131 to the negative direction of the Z-axis; the first bracket plate 11 and the second bracket plate 12 are spaced apart along the X-axis direction, and the main surfaces of the first bracket plate 11 and the second bracket plate 12 are opposite each other.

Figure 4:
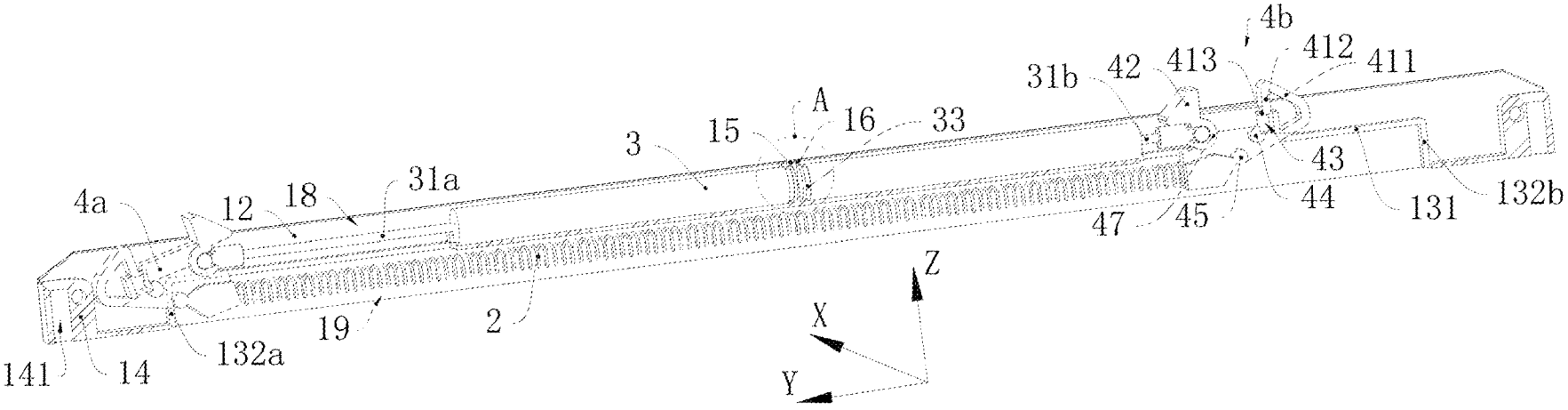
FIG. 4 is a cross-sectional view of a bidirectional damper according to an embodiment of the present disclosure.

Referring to FIGS. 3 and 4, the connecting plate 13 and the fixing blocks 14 are connected between the first bracket plate 11 and the second bracket plate 12, the two fixing blocks 14 are respectively located at both ends of the bidirectional damper 200 along the Y-axis direction, the first bracket plate 11, the second bracket plate 12 and the two fixing blocks 14 define a mounting chamber, the connecting plate 13 divides the mounting chamber into an upper chamber 18 and a lower chamber 19, the upper chamber 18 is located on the positive Z-axis side of the connecting plate 13, the lower chamber 19 is located on the negative Z-axis side of the connecting plate 13, the cylinder bodies of the two damping cylinders 3 are fixed in the upper chamber 18, the two damping cylinders 3 are arranged back to back along the Y-axis direction, the axes of the piston rods 31 of the two damping cylinders 3 coincide with each other, the two piston rods 31 are respectively a first piston rod 31*a* and a second piston rod 31*b*, the two piston rods 31 extend and retract in the Y-axis direction, the two piston rods 31 extend and retract in opposite directions, and each of the two engaging members 4 is hinged to a corresponding one of the two piston rods 31 respectively.

Figure 5:
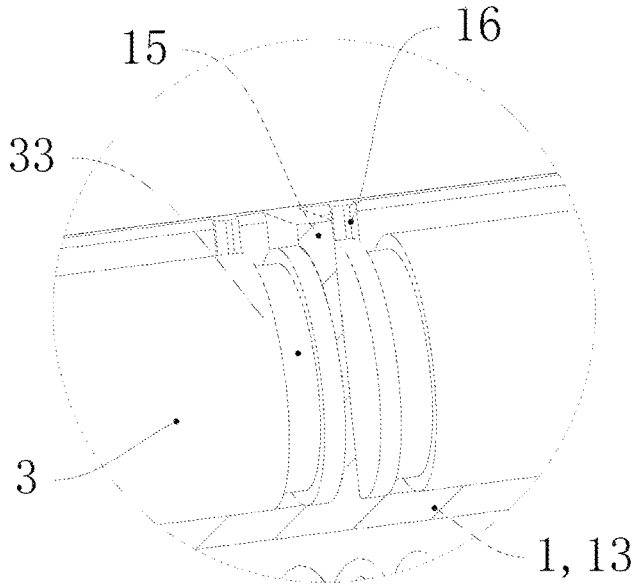
FIG. 5 is a partial enlarged view at A in FIG. 4.

Preferably, referring to FIGS. 3 to 5, a partition 15 is provided in a middle of the upper chamber 18 in the Y-axis direction, and the two damping cylinders 3 are disposed on both sides of the partition 15, respectively. Specifically, a limiting groove 33 is formed in the cylinder body of the damping cylinder 3, a first limiting protrusion 16 and a second limiting protrusion 17 are provided on the mounting bracket 1, the first limiting protrusion 16 is embedded in the limiting groove 33, and the cylinder body of the damping cylinder 3 is limited between the second limiting protrusion 17 and the partition 15 along the Y-axis direction. This facilitates the firm mounting of the damping cylinder 3 on the mounting bracket 1.

Alternatively, both damping cylinders 3 are gas-liquid damping cylinders, and the damping direction of the damping cylinder 3 is the direction in which the piston rod 31 is retracted into the cylinder chamber.

Specifically, referring to FIGS. 2 and 3, the fixing block 14 is provided with a mounting hole passing through along the Z-axis direction to facilitate fixing the mounting bracket 1 on the movable door panel 100 by screws.

Referring to FIG. 3, the connecting plate 13 is provided with two guide grooves 133 passing through the connecting plate 13, the two guide grooves 133 are respectively a first guide groove 133*a* and a second guide groove 133*b*, the two guide grooves 133 are located at both ends of the connecting plate 13 in the Y-axis direction respectively, each of the two guide grooves 133 penetrates through a corresponding one of the two extension sections 132 respectively, the guide grooves 133 extend from the extension sections 132 to the main body section 131, the guide grooves 133 extend on the main body section 131 along the Y-axis direction, each of the two engaging members 4 corresponds to a corresponding one of the two guide grooves 133 respectively, and each engaging member 4 is slidably arranged in the corresponding guide groove 133.

Figure 6:
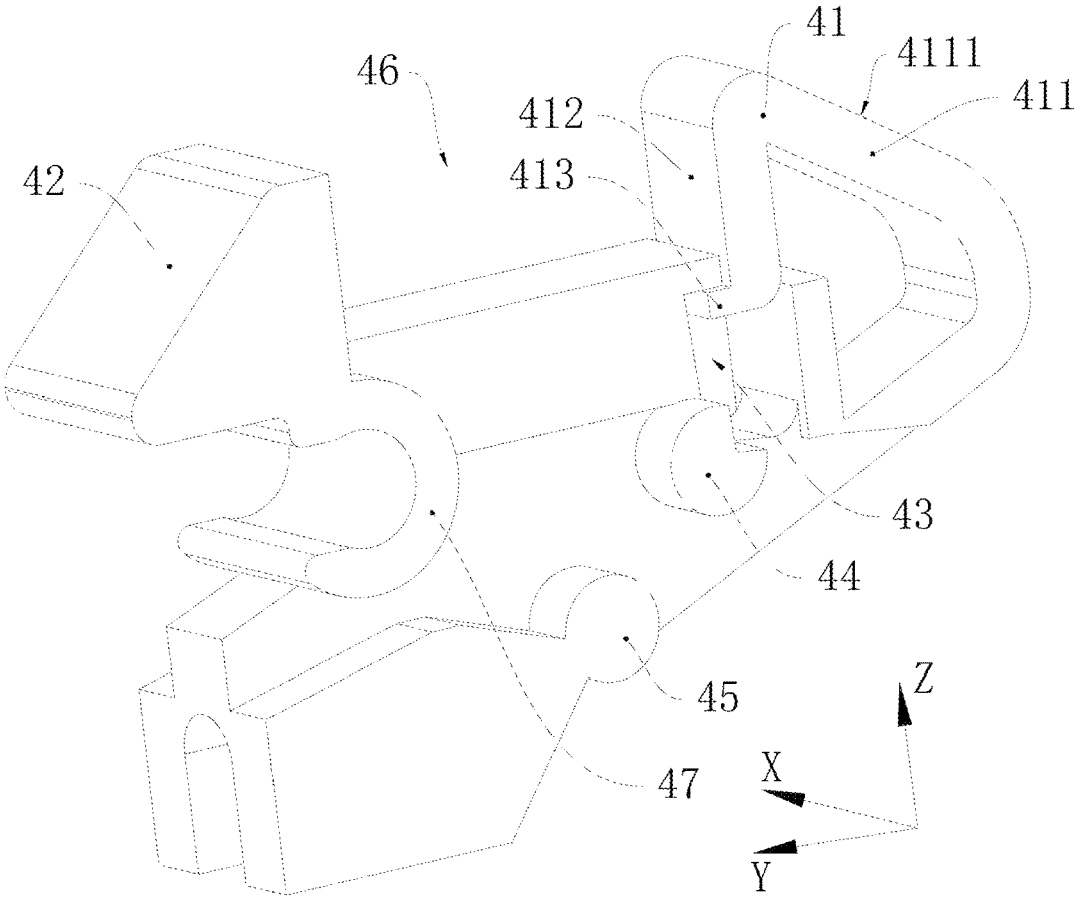
FIG. 6 is a structural view of an engaging member in a bidirectional damper according to an embodiment of the present disclosure.

Referring to FIG. 6, the engaging member 4 is provided with a first engaging tooth 41, a second engaging tooth 42, a first guide 44, and a second guide 45, when the engaging member 4 slides to the main body section 131, both the first engaging tooth 41 and the second engaging tooth 42 extend along the positive Z-axis direction from the engaging member 4, both the first engaging tooth 41 and the second engaging tooth 42 are exposed outside the mounting bracket 1, the first engaging tooth 41 and the second engaging tooth 42 are spaced apart along the Y-axis direction, a bayonet 46 is formed between the first engaging tooth 41 and the second engaging tooth 42, and two second engaging teeth 42 are located between two first engaging teeth 41 along the Y-axis direction.

Referring to FIGS. 4 and 6, both the first guide 44 and the second guide 45 protrude from the engaging member 4 along the X-axis direction, both the first guide 44 and the second guide 45 are cylinders, the distance between the first guide 44 and the second guide 45 is greater than the thickness of the connecting plate 13, the first guide 44 abuts against the sidewall of the connecting plate 13 facing away from the tension spring 2, the second guide 45 abuts against the sidewall of the connecting plate 13 facing the tension spring 2, the tension spring 2 is located in the lower chamber 19, and the tension spring 2 is connected between the two engaging members 4.

If only two guiding structures, namely, the first guide 44 and the second guide 45, are provided on the engaging member 4, when the second engaging tooth 42 abuts against the limiting member, the pressing force between the limiting member and the second engaging tooth 42 may cause the engaging member 4 to turn around the hinge of the engaging member 4 and the piston rod 31, causing the engaging member 4 to disengage from the limiting member and causing the bidirectional damper to fail, and therefore, referring to FIGS. 4 and 6, in the present embodiment, a third guide 47 is further provided on the engaging member 4, the third guide 47 abuts against the side of the connecting plate 13 facing away from the tension spring 2, and the second guide 45 is located between the first guide 44 and the third guide 47 along the Y-axis direction. The connecting plate 13 abut against the first guide 44, the second guide 45 and the third guide 47 to limit the orientation of the engaging member 4 in the guide groove 133, so as to prevent the engaging member 4 from turning over, which is beneficial to ensuring the stable state of the engaging member 4. Specifically, the piston rod 31 is hinged to the third guide 47 of the engaging member 4.

Alternatively, the engaging member 4 and the piston rod 31 may be hinged by a spherical joint, and of course, the engaging member 4 and the piston rod 31 may also be hinged by a planar hinge, the hinge axis direction of the planar hinge is in the X-axis direction, and the engaging member 4 and the piston rod 31 are preferably hinged by a planar hinge, which is more conducive for stable and regular movement of the engaging member 4.

Referring to FIGS. 3 and 4, to better illustrate the operation of the bidirectional damper 200 and the shower door assembly of the present embodiment, in the present embodiment, the engaging member 4 at the positive end of the Y axis is a first engaging member 4*a*, the engaging member 4 at the negative end of the Y axis is a second engaging member 4*b*, the limiting member at the positive end of the Y axis is a first limiting member, the limiting member at the negative end of the Y axis is a second limiting member, the extension section 132 at the positive end of the Y axis is a first extension section 132*a*, the extension section 132 at the negative end of the Y axis is a second extension section 132*b*, the guide groove 133 at the positive end of the Y axis is a first guide groove 133*a*, and the guide groove 133 at the negative end of the Y axis is a second guide groove 133*b*; the piston rod 31 at the positive end of the Y-axis is a first piston rod 31*a*, and the piston rod 31 at the negative end of the Y-axis is a second piston rod 31*b*.

Assuming that the movable door panel 100 is in the door-opening state in the initial state, the second limiting member is located in the bayonet of the second engaging member 4*b*, the second engaging member 4*b* is located in the second guide groove 133*b* of the main body section, the first limiting member and the first engaging member 4*a* are in the disengaged state, the first engaging member 4*a* is located at the first extension section 132*a*, the first guide 44 of the first engaging member 4*a* abuts against the first extension section 132*a*, and the first engaging tooth 41 of the first engaging member 4*a* sinks in the upper chamber 18 of the mounting bracket 1.

In the process of closing the door from the initial state, the operation of the first engaging member 4*a* and the first piston rod 31*a* is as follows: a user manually moves the movable door panel 100 in the positive direction along the Y-axis, the first engaging member 4*a* moves in the positive direction along the Y-axis along with the movable door panel 100 until the first engaging member 4*a* moves to the first limiting member, because the first engaging tooth 41 of the first engaging member 4*a* sinks in the upper chamber 18, the first engaging tooth 41 of the first engaging member 4*a* can smoothly pass under the first limiting member, the first limiting member contacts with the second engaging tooth 42 of the first engaging member 4*a*, the second engaging tooth 42 of the first engaging member 4*a* cannot continue to move in the positive direction along the Y-axis under the blocking of the first limiting member, and the movable door panel 100 continues to move in the positive direction along the Y-axis; with the continuous movement of the movable door panel 100, the first engaging member 4*a* slides along the first guide groove 133*a* relative to the movable door panel 100, the first piston rod 31*a* retracts into the cylinder chamber of the damping cylinder 3, the damping cylinder 3 starts to damp the door closing motion of the movable door panel 100, the movable door panel 100 completes the door closing motion under the obstruction of the damping cylinder 3, and after the first engaging member 4*a* completely slides to the main body section 131 relative to the mounting bracket 1, the first engaging tooth 41 of the first engaging member 4*a* is exposed out of the upper chamber 18 under the guidance of the first guide groove 133*a*, and the first limiting member is limited in the bayonet 46 of the first engaging member 4*a*.

In the process of closing the door from the initial state, the operation of the second engaging member 4*b* and the second piston rod 31*b* is as follows: the user manually moves the movable door panel 100 in the positive direction along the Y-axis, the second engaging member 4*b* cannot move in the positive direction along the Y-axis along with the movable door panel 100 under the limitation of the second limiting member, the second engaging member 4*b* returns to the second extension section 132*b* along the second guide groove 133*b* relative to the mounting bracket 1, until the second engaging member 4*b* moves to the second extension section 132*b*, the first engaging tooth 41 of the second engaging member 4*b* sinks in the upper chamber 18, and the first engaging tooth 41 of the second engaging member 4*b* disengages from the second limiting member.

The door opening process of the bidirectional damper 200 is similar to the door closing process, and will not be repeated here.

Alternatively, the number of the tension springs 2 may be two, each of the two tension springs corresponds to a corresponding one of the two engaging members 4 respectively, one end of each tension spring is connected with the mounting bracket 1, and the other end of each tension spring is connected with the corresponding engaging member 4; of course, referring to FIG. 4, the number of the tension spring 2 may be one, and both ends of the tension spring 2 are connected to the two engaging members 4, respectively. Preferably, the number of the tension spring 2 is one, which is beneficial to reducing the number of parts of the bidirectional damper 200, reducing the production difficulty of the bidirectional damper 200, simplifying the structure of the bidirectional damper 200, and improving the economy.

Alternatively, the damping cylinder 3 may also be provided as a single cylinder, and the damping cylinder is a dual-chamber cylinder, and each of the two cylinder chambers corresponds to one piston rod 31 respectively.

Preferably, referring to FIG. 6, the first engaging tooth 41 is a bent structure, the first engaging tooth 41 includes a first bent section 411, a second bent section 412 and a third bent section 413, and along the Y-axis direction, the end of the first bent section 411 away from the second engaging tooth 42 is connected to the main body portion of the engaging member 4, and the end of the first bent section 411 close to the second engaging tooth 42 is connected to the second bent section 412; the second bent section is bent from the first bent section to the negative Z-axis direction, and the negative Z-axis end of the second bent section 412 is connected to the third bent section 413; the third bent section 413 is bent from the second bent section 412 in the Y-axis direction (either the positive Y-axis direction or the negative Y-axis direction), the second bent section 412 is provided with an inclined guide surface 4111, the inclined guide surface 4111 is located on one side of the second bent section 412 facing the positive Z-axis direction, and the inclined guide surface 4111 is located on one side of the second bent section 412 facing away from the second engaging tooth 42 in the Y-axis direction.

Due to the arrangement of the inclined guide surface 4111, when the engaging member 4 reaches the limiting member in the door opening and closing process of the movable door panel 100, even if the first engaging tooth 41 is exposed out of the upper chamber 18 and interferes with the limiting member, the limiting member can also force the first engaging tooth 41 to sink back into the upper chamber 18 under the guidance of the inclined guide surface 4111, so that the first engaging tooth 41 smoothly passes under the limiting member, which is beneficial to the continuous normal operation of the bidirectional damper 200.

When the engaging member 4 moves along with the movable door panel 100 and reaches the limiting member, the first engaging tooth 41 needs to pass through the limiting member, because when the movable door panel 100 moves in the reverse direction, the first engaging tooth 41 can cooperate with the limiting member to drive the engaging member 4 to smoothly return to the guide groove 133 of the extension section 132, so that the bidirectional damper 200 can repeatedly exert the function of generating damping. However, even in this case, the situation that the engaging member 4 does not return to the extension section 132 after being disengaged from the limiting member may still occur, for example, the engaging member 4 returns to the main body section 131 after being disengaged from the limiting member, at this time, the main body section 131 limits the first engaging tooth 41 from sinking, even with the guidance of the guide surface 4111, the first engaging tooth 41 cannot sink into the upper chamber 18, so that the first engaging tooth 41 cannot pass under the limiting member smoothly, the limiting member cannot reach the bayonet 46 of the engaging member 4 smoothly, and further the engaging member 4 cannot be driven to return to the extension section 132 by the cooperation of the limiting member and the first engaging tooth 41 when the movable door panel 100 moves reversely, so that the piston rod 31 is in a state of retracting into the damping cylinder 3 all the time, and the damping cylinder 3 cannot continue to damp the movement of the movable door panel 100, thereby causing the bidirectional damper 200 to fail; therefore, in the present embodiment, the first engaging tooth 41 is designed to be a bent structure, so that even if the engaging member 4 is located at the main body section 131 when reaching the limiting member, the limiting member can also force the first bent section 411 to bend downward by squeezing and deforming the first engaging tooth 41, so that the first engaging tooth 41 passes through the limiting member, the limiting member can smoothly reach the bayonet 46 of the engaging member 4, the engaging member 4 is guaranteed to have smoothly returned to the extension section 132 when being disengaged from the limiting member, which is beneficial to the long-term normal operation of the bidirectional damper 200.

More preferably, the engaging member 4 is provided with a limiting structure having a limiting cavity 43 with an opening facing the first engaging tooth 41, the second bent section 412 penetrating into the opening of the limiting cavity 43, and the third bent section 413 located in the limiting cavity 43, wherein the limiting structure restricts the third bent section 413 from being separated from the limiting cavity 43, and the third bent section 413 is spaced apart from the bottom wall of the limiting cavity 43. In this way, during the return of the engaging member 4 from the main body section 131 to the extension section 132, the limiting member abuts against the second bent section 412 to prevent the limiting member from being engaged under the first bent section 411, and ensure that the limiting member and the engaging member 4 can be smoothly disengaged after the engaging member 4 returns to the extension section 132; further, under the restriction of the limiting structure, besides the first bent section 411 can perform limited sinking deformation and recovery deformation, the limiting structure restricts the second bent section 412 to deform along the Y-axis direction, and restricts the deformation range of the first bent section 411 by restricting the third bent section 413 to separate from the limiting cavity 43, so as to ensure the orientation stability of the first engaging tooth 41 and the controllable deformation of the first engaging tooth 41.

Finally, it should be emphasized that the above description is merely preferred embodiments of the present disclosure and is not intended to limit the present disclosure, and it should be understood that various changes and modifications may be made by those skilled in the art, and any changes, equivalents, improvements and the like, which fall within the spirit and principle of the present disclosure, shall be included in the scope of the present disclosure.

INDUSTRIAL APPLICABILITY

The bidirectional damper of the present disclosure is mounted in a shower door assembly, the shower door assembly provided by the present disclosure is installed in a bathroom and serves as an important constituent part of a shower room, the shower room may be an integral shower room with a chassis, or the shower door assembly may be installed between walls adjacent to each other and forming an included angle, and the shower room is surrounded by a movable door panel, a fixed door panel and the walls. The bidirectional damper is fixed at the top or the bottom of the movable door panel, and cooperates with the limiting members on the doorframe to provide a buffer for the opening and closing movement of the movable door panel, so that the high-speed collision between the movable door panel and the doorframe is avoided, and the noise from the use of the shower door assembly is reduced.

The invention claimed is:

1. A bidirectional damper, comprising a mounting bracket, a tension spring, a damping cylinder and two engaging members, wherein:

the mounting bracket comprises a first bracket plate and a second bracket plate with opposite main surfaces, the first bracket plate and the second bracket plate are spaced apart along a first direction, the mounting bracket further comprises a connecting plate connected between the first bracket plate and the second bracket plate, the connecting plate comprises a main body section and two extension sections, wherein the first bracket plate, the second bracket plate and the connecting plate are all elongated plates, length directions of the first bracket plate, the second bracket plate and the main body section are all in a second direction, the second direction is perpendicular to the first direction, and the main body section is connected between the two extension sections along the second direction;

the damping cylinder, the tension spring and the two engaging members are all positioned between the first bracket plate and the second bracket plate; along a third direction, the damping cylinder and the tension spring are respectively arranged at two sides of the connecting plate, both of the two extension sections are bent from the main body section towards the tension spring, the third direction is perpendicular to the first direction, and the third direction is perpendicular to the second direction; the damping cylinder comprises two piston rods extending and retracting in the second direction, each of the two engaging members is hinged to a corresponding one of the two piston rods respectively, and damping directions of the two piston rods are opposite;

the connecting plate is provided with two guide grooves passing through the connecting plate, each of the two guide grooves corresponds to a corresponding one of the two extension sections respectively, each of the guide grooves extends from corresponding extension section to the main body section, the guide grooves extend in the second direction on the main body section, each of the two engaging members is slidably arranged in a corresponding one of the two guide grooves respectively, and both of the two engaging members are connected with the tension spring;

each engaging member is provided with a first guide, a first engaging tooth and a second engaging tooth, the first engaging tooth and the second engaging tooth are spaced apart along the second direction, and along the third direction, the first guide abuts against a side of the connecting plate facing away from the tension spring under the action of the tension spring, both the first engaging tooth and the second engaging tooth extend to a side of the connecting plate close to the damping cylinder.

2. The bidirectional damper according to claim 1, wherein:

the damping cylinder comprises two separate cylinder bodies, and each of the two cylinder bodies of the damping cylinder corresponds to a corresponding one of the two piston rods respectively; or the damping cylinder comprises a dual-chamber cylinder body, and two cylinder chambers of the damping cylinder each correspond to a corresponding one of the two piston rods respectively.

3. The bidirectional damper according to claim 1, wherein:

each engaging member is further provided with a second guide, a distance between the first guide and the second guide is greater than a thickness of the connecting plate, and the second guide abuts against a side of the connecting plate facing the tension spring.

4. The bidirectional damper according to claim 3, wherein:

each engaging member is further provided with a third guide, the third guide abuts against a side of the connecting plate facing away from the tension spring, and the second guide is located between the first guide and the third guide along the second direction.

5. The bidirectional damper according to claim 1, wherein:

the two engaging members are connected with same tension spring.

6. The bidirectional damper according to claim 1, wherein:

the tension spring includes a first tension spring and a second tension spring, one of the engaging members is connected with the first tension spring, and the other one of the engaging members is connected with the second tension spring, both the first tension spring and the second tension spring are connected with the mounting bracket.

7. The bidirectional damper according to claim 1, wherein:

each first engaging tooth is provided with an inclined guide surface, two of the second engaging teeth are positioned between two of the first engaging teeth along the second direction, and the inclined guide surface is positioned on a side of each first engaging tooth facing away from the corresponding second engaging tooth;

the inclined guide surface is positioned on a side of each first engaging tooth facing away from the tension spring along the third direction.

8. The bidirectional damper according to claim 7, wherein:

each first engaging tooth is a bent structure and comprises a first bent section and a second bent section, and along the second direction, an end of the first bent section away from the corresponding second engaging tooth is connected to a main body portion of the engaging member, and an end of the first bent section close to the corresponding second engaging tooth is connected to the second bent section;

along the third direction, the second bent section is bent from the first bent section towards the tension spring, and a space is formed between a side of the second bent section facing the tension spring and the main body portion of the engaging member; and the inclined guide surface is provided on the first bent section.

9. The bidirectional damper according to claim 8, wherein:

each first engaging tooth further comprises a third bent section, and along the third direction, an end of the second bent section facing the tension spring is connected with the third bent section;

each engaging member is provided with a limiting structure having a limiting cavity with an opening facing the corresponding first engaging tooth, the second bent section penetrates into the opening of the limiting cavity, the third bent section is located in the limiting cavity, wherein the limiting structure restricts the third bent section from being separated from the limiting cavity.

10. A shower door assembly comprising the bidirectional damper according to claim 1, further comprising a movable door panel and a mounting base, wherein the bidirectional damper is mounted on top or bottom of the movable door panel, the second direction is the same as a sliding direction of the movable door panel, the mounting bracket is fixed to the movable door panel, two limiting members are provided on the mounting base, each of the two limiting members corresponds to a corresponding one of the two engaging members respectively, and the limiting members are located on movement paths of corresponding engaging members.

* * * * *